US011624311B2

(12) United States Patent
Misumi et al.

(10) Patent No.: US 11,624,311 B2
(45) Date of Patent: Apr. 11, 2023

(54) ENGINE COOLING SYSTEM

(71) Applicant: Mazda Motor Corporation, Hiroshima (JP)

(72) Inventors: Haruki Misumi, Aki-gun (JP); Tomonori Urushihara, Aki-gun (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 17/718,560

(22) Filed: Apr. 12, 2022

(65) Prior Publication Data

US 2022/0364494 A1 Nov. 17, 2022

(30) Foreign Application Priority Data

May 13, 2021 (JP) ..... JP2021-081822

(51) Int. Cl.
*F01P 7/16* (2006.01)
*F01P 3/02* (2006.01)
*F01P 7/14* (2006.01)

(52) U.S. Cl.
CPC ..... *F01P 7/16* (2013.01); *F01P 3/02* (2013.01); *F01P 2003/024* (2013.01); *F01P 2007/146* (2013.01)

(58) Field of Classification Search
CPC ..... F01P 3/02; F01P 7/14; F01P 7/16; F01P 7/165; F01P 2003/024; F01P 2003/027; F01P 2003/028; F01P 2007/146
See application file for complete search history.

(56) References Cited

U.S. PATENT DOCUMENTS 5,809,944 A * 9/1998 Aoki ..... B60H 1/00878 123/41.02
2005/0034688 A1* 2/2005 Lelkes ..... F16K 11/074 123/41.01
2012/0055652 A1* 3/2012 Triebe ..... F01P 7/161 165/96

(Continued)

FOREIGN PATENT DOCUMENTS

EP 2562379 A1 * 2/2013 ..... F01P 7/14
JP 2016128652 A 7/2016
WO WO-2019176261 A1 * 9/2019

*Primary Examiner* — John M Zaleskas
(74) *Attorney, Agent, or Firm* — Alleman Hall Creasman & Tuttle LLP

(57) ABSTRACT

An engine cooling system is provided, which includes a water jacket through which coolant flows, a heat exchanger that cools the coolant, a bypass passage that bypasses the heat exchanger and recirculates the coolant to the water jacket, a first radiator passage that recirculates the coolant to the water jacket via the heat exchanger, a flow control device installed at a location where a coolant passage branches into the bypass passage and the first radiator passage, a second radiator passage that bypasses the flow control device and is connected to the first radiator passage, and a thermally-actuated valve installed in the second radiator passage. The flow control device performs a water flow control to adjust a coolant amount flowing into the water jacket by adjusting a coolant amount flowing through the bypass passage. The coolant flows into the first radiator passage through the second radiator passage, when the valve opens.

4 Claims, 8 Drawing Sheets

(56) References Cited

U.S. PATENT DOCUMENTS

2013/0167786 A1* 7/2013 Mehring ..... F01P 3/02 123/41.82 R
2013/0221116 A1* 8/2013 Tsuchiya ..... F01P 7/16 236/34.5
2014/0190427 A1* 7/2014 Nagahama ..... F01P 7/16 123/41.1
2015/0122359 A1* 5/2015 Tsuchiya ..... F01P 7/14 137/625.47
2016/0010536 A1* 1/2016 Murakami ..... F01P 7/14 137/625.44
2017/0016381 A1* 1/2017 Yumisashi ..... F16K 31/043
2017/0074154 A1* 3/2017 Kaneko ..... F01P 7/14
2017/0184008 A1* 6/2017 Nagai ..... F01P 7/167
2017/0321595 A1* 11/2017 Jang ..... F01P 7/16
2017/0335749 A1* 11/2017 Maruyama ..... F16K 11/0873
2017/0335750 A1* 11/2017 Yumisashi ..... F16K 5/205
2018/0051620 A1* 2/2018 Lee ..... F16K 11/163
2018/0119827 A1* 5/2018 Ozeki ..... F16K 27/065
2018/0119828 A1* 5/2018 Ozeki ..... F16K 11/0856
2018/0119836 A1* 5/2018 Ozeki ..... F16K 11/085
2018/0283258 A1* 10/2018 Watanabe ..... F01P 7/16
2018/0335153 A1* 11/2018 Ozeki ..... F16K 5/0485
2018/0347448 A1* 12/2018 Morota ..... F01P 7/16
2019/0010857 A1* 1/2019 Kaneko ..... F01P 7/167
2019/0120121 A1* 4/2019 Lee ..... F01P 7/165
2019/0162106 A1* 5/2019 Lee ..... F01P 7/165
2019/0376439 A1* 12/2019 Fujita ..... F01P 3/14
2020/0072117 A1* 3/2020 Imasaka ..... F01P 7/165
2020/0256241 A1* 8/2020 Sano ..... F01P 7/14
2020/0309275 A1* 10/2020 Ozeki ..... F16K 31/002
2020/0309276 A1* 10/2020 Ozeki ..... F16K 5/181
2021/0080014 A1* 3/2021 Sato ..... F16K 27/06
2022/0243830 A1* 8/2022 Sato ..... F16K 27/06
2022/0364495 A1* 11/2022 Misumi ..... F01P 7/165
2022/0364496 A1* 11/2022 Misumi ..... F01P 3/20

* cited by examiner

| TEMPERATURE STATE OF COMBUSTION CHAMBER | LOW TEMPERATURE | WARM-UP | FULL WARM-UP |
|---|---|---|---|
| BYPASS PASSAGE | NOT FLOW | FLOWS IN | FLOW ACCORDING TO LOAD |
| 1ST RADIATOR PASSAGE | NOT FLOW | NOT FLOW | |
| CCV STATE |  |  |  |

ENGINE COOLING SYSTEM

TECHNICAL FIELD

The disclosed technique relates to a cooling system for an engine, especially to a technique for controlling a temperature of a combustion chamber of the engine with high precision.

BACKGROUND OF THE DISCLOSURE

JP2016-128652A discloses a cooling device for an engine. This cooling device includes a radiator route 23 which circulates coolant between the engine and a radiator, and a radiator bypass route 24 which bypasses the radiator and circulates coolant.

The radiator bypass route 24 includes a first bypass route 25 in which apparatuses 31, 32 which are targets of heat exchange are installed, and a second bypass route 26 only with piping. The coolant which flowed through the radiator route 23 and the radiator bypass route 24 is returned to a water pump 21 through a return route 27.

A maximum flow rate of the second bypass route 26 is dramatically small compared with a maximum flow rate of each of the radiator route 23 and the first bypass route 25 (see FIG. 7 of JP2016-128652A).

The cooling device also includes a rotary flow control valve 50. The rotary flow control valve 50 controls a rotational position of a rotary valve body 51 according to a temperature of a fluid temperature sensor 77 installed in a circulation path 76 inside a housing. Thus, the flow of the coolant to the radiator route 23, the first bypass route 25, and the second bypass route 26 is controlled.

A combustion chamber becomes high temperature while the engine operates. In order to cool the combustion chamber, as also provided to the cooling device of JP2016-128652A, a passage through which the coolant cooled by the radiator flows (so-called "water jacket") is formed in a part of a cylinder bore, a cylinder head, etc. which constitute a main body of the engine, around the combustion chamber.

Meanwhile, in the engine combustion control, the temperature inside the combustion chamber (in-cylinder temperature) is one of important factors. More precise control of the in-cylinder temperature is required as the combustion control becomes more advanced. For example, in order to stably control the compression ignition combustion (CI combustion), it is necessary to more accurately control the in-cylinder temperature at a temperature higher than in the spark ignition combustion (SI combustion).

In the in-cylinder temperature control, a wall temperature of the combustion chamber is one of important factors. Like the conventional technique, only keeping the low temperature of the coolant which circulates in the water jacket in order to suppress an excessive temperature increase of the combustion chamber cannot realize the advanced combustion control. Rather, it is necessary to stably control the cooling by the coolant with a high response so that the wall temperature of the combustion chamber can be controlled.

In the cooling device of JP2016-128652A, the radiator bypass route is comprised of the first bypass route and the second bypass route. The first bypass route is long, where the apparatuses which are targets of heat exchange are installed. On the other hand, the second bypass route is short, and is comprised only of piping. However, the upper limit flow rate of the second bypass route is dramatically small compared with the upper limit flow rate of the first bypass route.

Therefore, when cooling while bypassing the radiator, most of the coolant flows into the first bypass route. An amount of coolant which flows into the second bypass route is small. Therefore, because of external causes such as environmental temperature, and influences of apparatuses, the temperature of the coolant which flows into the water jacket will not become stable. The amount of coolant which flows into the water jacket does not change much, either. Therefore, it is difficult to stably control the cooling by the coolant.

When cooling via the radiator, the path through which the coolant flows becomes even longer. Therefore, the response of the control is slow, and it is easy to be influenced by the environmental temperature, etc. Therefore, also in this case, it is difficult to stably control the cooling by the coolant with high response.

SUMMARY OF THE DISCLOSURE

Thus, the disclosed technique aims at stably controlling cooling of a water jacket by coolant with a high response. Therefore, an advanced combustion control, such as CI combustion, can be realized.

According to one aspect of the present disclosure, a cooling system for an engine is provided, which includes a water jacket formed in a cylinder head of the engine and through which coolant flows, a heat exchanger that cools the coolant, a bypass passage that bypasses the heat exchanger and recirculates the coolant to the water jacket, a first radiator passage that recirculates the coolant to the water jacket via the heat exchanger, a flow control device installed at a location where a passage of the coolant branches into the bypass passage and the first radiator passage, a second radiator passage that bypasses the flow control device and is connected to the first radiator passage, and a thermally-actuated valve installed in the second radiator passage.

The flow control device performs a water flow control to adjust an amount of coolant flowing into the water jacket by adjusting an amount of coolant flowing through the bypass passage.

Further, by the thermally-actuated valve opening, the coolant is recirculated to the water jacket through the second radiator passage and the first radiator passage.

The bypass passage that bypasses the heat exchanger and the first radiator passage that passes the heat exchanger are provided in this engine cooling system. According to this configuration, the coolant flowing through the first radiator passage is cooled by the heat exchanger, but the coolant flowing through the bypass passage is not cooled by the heat exchanger.

Further, the flow control device installed at the branched part of the bypass passage and the first radiator passage, performs the water flow control to adjust the amount of coolant flowing in the water jacket formed in the cylinder head of the engine (i.e., the periphery of a combustion chamber), through the bypass passage.

That is, when the water flow control is performed, the amount of coolant which circulates in the water jacket without being cooled by the heat exchanger is adjusted. In detail, if the amount of coolant which flows in the water jacket decreases, the heat transfer coefficient between the water jacket and the combustion chamber also decreases accordingly. If the amount of coolant which flows in the water jacket increases, the heat transfer coefficient between the water jacket and the combustion chamber also increases accordingly.

By this water flow control, the heat transfer coefficient between the water jacket and the combustion chamber can be adjusted, and as a result, a wall temperature of the combustion chamber can be held constant.

In addition, in this cooling system, the second radiator passage that bypasses the flow control device and is connected to the first radiator passage is provided. Further, the thermally-actuated valve is provided to the second radiator passage. When the thermally-actuated valve opens, the coolant flows through the second radiator passage and flows into the first radiator passage.

The thermally-actuated valve opens and closes at a given high temperature set beforehand. Thus, if the temperature of the coolant flowing in the water jacket becomes excessively high, the coolant can be flowed into the first radiator passage independently of the flow control device. Since the coolant flowed into the first radiator passage is cooled, the temperature of the coolant which is circulated in the water jacket can be reduced. As a result, while setting the temperature of the circulating coolant high, it can suppress the coolant temperature from becoming excessively high.

By the combination of the water flow control using the bypass passage and the high temperature control using the thermally-actuated valve, the cooling of the water jacket with the coolant can be stably controlled with high response. As a result, the advanced combustion control can be achieved as well as improving fuel efficiency.

Furthermore, the thermally-actuated valve is installed at a part of bypassing the flow control device. Therefore, even if the abnormality occurs in the flow control device and the coolant temperature rises, when the temperature becomes above a given temperature, the thermally-actuated valve opens to cool the coolant by the heat exchanger. It can suppress the overheat of the engine.

In the cooling system, the flow control device may perform a water temperature control to adjust a temperature of the coolant which flows into the water jacket by adjusting an amount of coolant flowing through the first radiator passage.

That is, when the water temperature control is performed, among the coolant which circulates in the water jacket, the amount of coolant to be cooled by the heat exchanger is adjusted. Thus, even if the amount of coolant flowing in the water jacket is constant (i.e., not performing the water flow control), a heat exchanging quantity with the combustion chamber can be changed.

Therefore, by combining the water flow control with the water temperature control, a range where the temperature of the coolant flowing in the water jacket can be stabilized can be expanded. As a result, the advanced combustion control can be achieved in the wide range, which further improves fuel efficiency.

In the cooling system, the flow control device may include a housing provided with an inflow opening through which the coolant inflows, and the bypass passage and the first radiator passage, a rotary valve body rotatably accommodated in the housing, intervening between the inflow opening and each of the bypass passage and the first radiator passage, and allowing the coolant flowed into the inflow opening by passing through a first water flow opening and a second water flow opening to flow into each of the bypass passage and the first radiator passage, and an actuator that rotates the rotary valve body. Amounts of coolant flowing through the bypass passage and the first radiator passage may be adjusted by controlling the actuator and changing openings of the first water flow opening and the second water flow opening, respectively.

According to this configuration, by the control of the actuator of the flow control device, the rotary valve body where the two water flow openings are formed rotates. By the rotary valve body being rotated, the opening between the inflow opening and each of the bypass passage and the first radiator passage is changed so that the amounts of the coolant flowing through the bypass passage and the first radiator passage is adjusted.

Therefore, only by the actuator rotating the rotary valve body, the amounts of the coolant flowing through each of the bypass passage and the first radiator passage can be adjusted. For example, the amount of the coolant flowing through each of the bypass passage and the first radiator passage can be set to zero, the amount of the coolant flowing through the bypass passage or the first radiator passage can be set to zero, or the amounts of the coolant flowing through each of the bypass passage and the first radiator passage can be changed. Since this is achieved only by the actuator rotating the rotary valve body, the coolant amount can easily be performed precisely.

The flow control device may include a first electromagnetic valve and a second electromagnetic valve that open and close passages of the coolant. Amounts of coolant flowing through the bypass passage and the first radiator passage may be adjusted by controlling the first electromagnetic valve and the second electromagnetic valve, respectively.

That is, in this cooling system, the flow control device is comprised of the two electromagnetic valves. For example, when changing the state between flowing or not flowing the coolant to each of the bypass passage and the first radiator passage, each of the first electromagnetic valve and the second electromagnetic valve can be opened or closed accordingly. When adjusting the amounts of the coolant flowing through each of the bypass passage and the first radiator passage, the open and close timings of the valve may be adjusted according to the target amounts.

According to this cooling system, since the flow control device is comprised of the two electromagnetic valves, the system configuration can be compact.

The temperature of the coolant flowing through the water jacket when the water flow control is performed and the water temperature control is not performed may be set higher than the temperature of the coolant flowing through the water jacket when the water temperature control is performed and the water flow control is not performed.

According to this cooling system, by combining the water flow control and the water temperature control, the range where the temperature of the coolant flowing in the water jacket can be stabilized can be expanded. Further, the temperature of the coolant flowing in the water jacket is set relatively higher when the water flow control is performed and the water temperature control is not performed, whereas is set relatively lower when the water temperature control is performed and the water flow control is not performed.

In the water temperature control, the heat exchanging quantity is adjusted by the coolant cooled by the heat exchanger. On the other hand, in the water flow control, the heat transfer coefficient is adjusted by changing the amount of the coolant circulating while bypassing the heat exchanger. Therefore, since the water flow control excels the water temperature control in the response and stability, the water flow control can stably control the cooling of the water jacket with the coolant even if it is set to a high temperature.

In this manner, the precise control of the coolant at the high temperature becomes possible, and the advanced combustion control can be performed stably while expanding the range.

DETAILED DESCRIPTION OF DISCLOSURE

Hereinafter, the disclosed technique is described. Note that the following description is merely illustration.

<Configuration of Cooling System>

Figure 1:
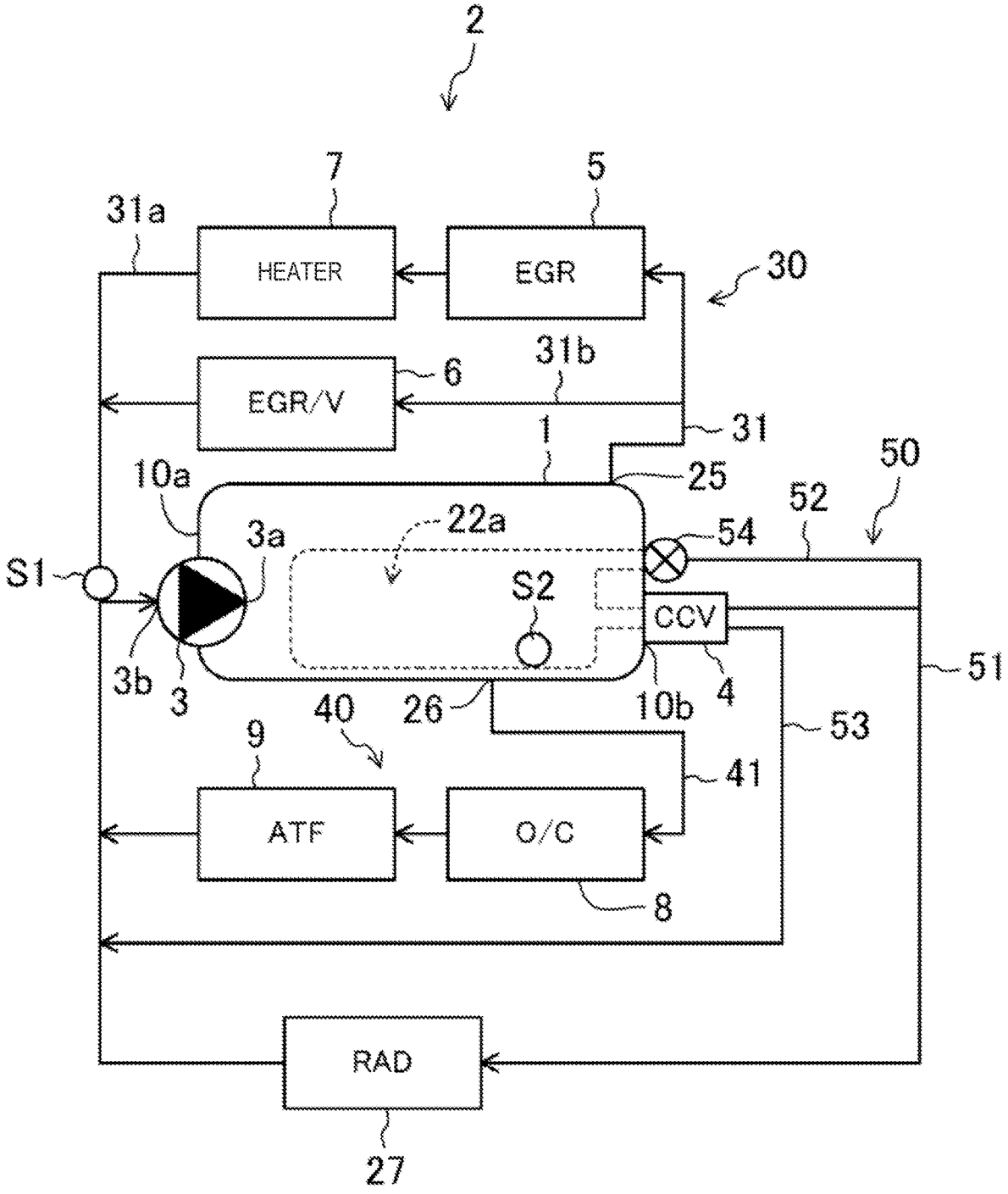
FIG. 1 is a schematic view illustrating a cooling system for an engine.

FIG. 1 illustrates a cooling system for an engine, which is constructed based on the disclosed technique. A cooling system 2 is mounted on an automobile (vehicle). The automobile travels by a driving force of the engine. Note that, although the automobile may be a hybrid vehicle carrying an engine and a motor, the automobile is a vehicle only carrying an engine in the following description.

(Engine, Auxiliary Machines)

The disclosed technique is applicable to both a gasoline engine and a diesel engine. However, from the viewpoint of the advanced combustion control, the gasoline engine is preferred. Therefore, an engine 1 is the gasoline engine in this embodiment.

Figure 2:
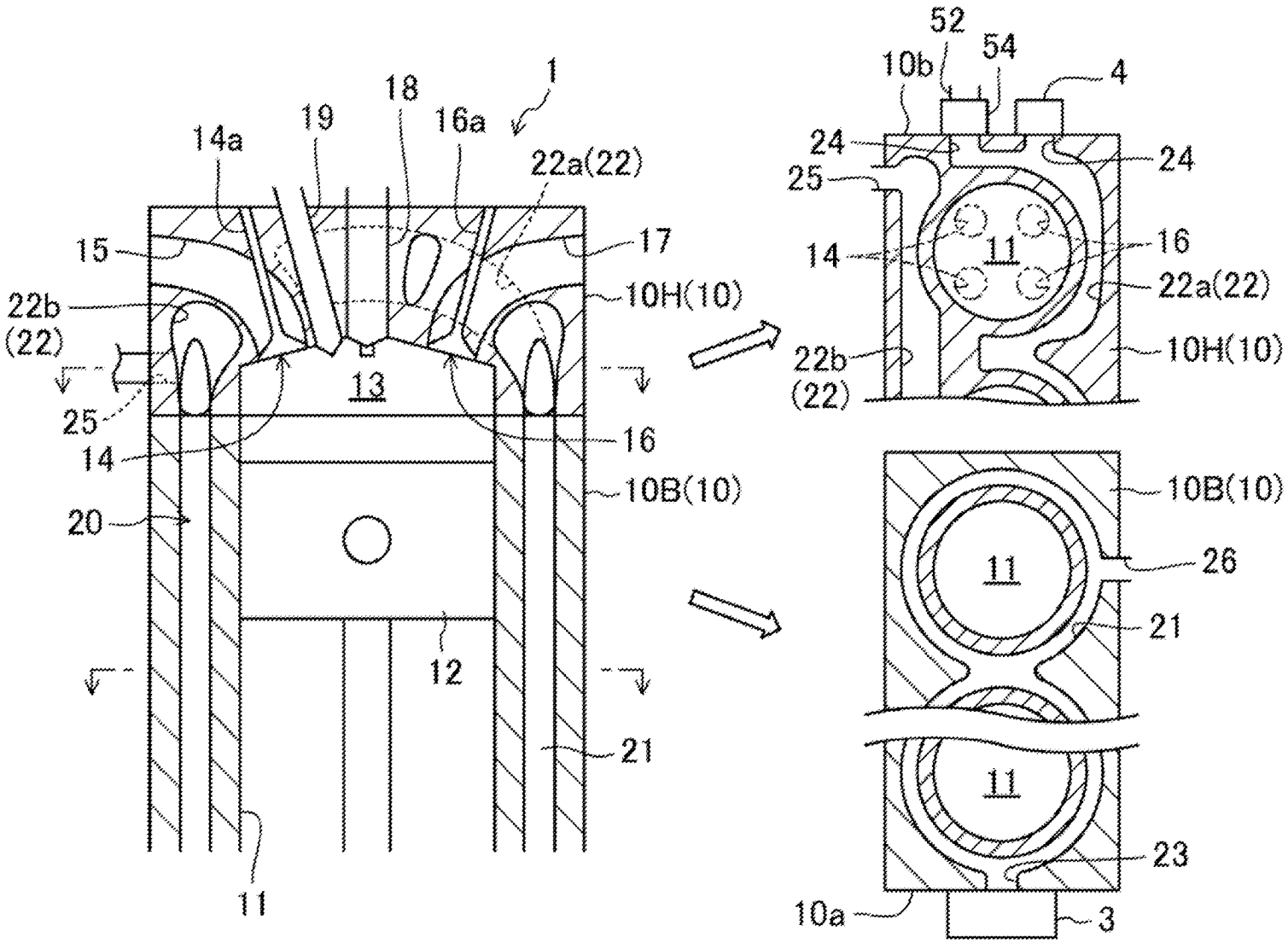
FIG. 2 is a schematic view illustrating an internal structure of an upper part of an engine body.

The engine 1 has an engine body 10 which is elongated in an extending direction of a driving shaft (not illustrated). FIG. 2 illustrates a simplified internal structure of an upper part of the engine body 10. The engine body 10 is comprised of a cylinder block 10B, and a cylinder head 10H assembled to an upper part of the cylinder block 10B. A plurality of cylinders (cylinders 11) lined up in series along the driving shaft are provided inside the engine body 10.

That is, a plurality of cylindrical cylinders 11 are formed in the cylinder block 10B. A piston 12 is slidably accommodated in each cylinder 11. A combustion chamber 13 is formed by partitioning each cylinder 11 with an upper surface of the piston 12, and a lower surface of the cylinder head 10H which covers an upper part of the cylinder 11.

In the lower surface of the cylinder head 10H which constitutes an upper surface of the combustion chamber 13, two exhaust openings 14 which are opened and closed by exhaust valves 14*a*, and two intake openings 16 which are opened and closed by intake valves 16*a*. Each exhaust opening 14 is connected with an exhaust device (outside the drawing) through an exhaust port 15. Each intake opening 16 is connected with an intake device (outside the drawing) through an intake port 17. In this engine 1, a spark plug 18 and a fuel injection valve 19 are attached between the exhaust openings 14 and the intake openings 16.

The engine 1 can inject gasoline into the combustion chamber 13 from the fuel injection valve 19. The engine 1 can ignite an air-fuel mixture which is formed inside the combustion chamber 13 by the spark plug 18 to combust the air-fuel mixture (so-called "spark ignition (SI) combustion"). Further, this engine 1 is designed so that a compression ratio (geometric compression ratio) is higher than engines which only perform SI combustion. The engine 1 is constructed so that it can also perform combustion by compression ignition (so-called "CI combustion").

A water jacket 20 through which cooling water (coolant) flows is formed inside the engine body 10. The water jacket 20 constitutes a part of a passage provided to the cooling system 2. The water jacket 20 has an in-block jacket 21, and an in-head jacket 22. The in-block jacket 21 is formed in the cylinder block 10B so that it spreads along the outer circumference of each cylinder.

The in-head jacket 22 is formed in the cylinder head 10H so that it communicates with the in-block jacket 21. The in-head jacket 22 has a first jacket 22*a* (an example of a "water jacket" in the disclosed technique), and a second jacket 22*b*. The first jacket 22*a* and the second jacket 22*b* constitute mutually independent passages.

The first jacket 22*a* is formed so that it extends along an upper part of each cylinder 11 (i.e., along the perimeter of the combustion chamber 13). Therefore, the coolant which flows through the first jacket 22*a* mainly exchanges heat with (mainly, cools) the combustion chamber 13 where combustion takes place.

In detail, the coolant which flows through the first jacket 22*a* exchanges heat with atmosphere inside the combustion chamber 13 via the wall surface of the combustion chamber 13. That is, a wall temperature of the combustion chamber 13 is cooled by the coolant which flows through the first jacket 22*a*. Therefore, in order to stably control the wall temperature of the combustion chamber 13, controlling the cooling by the coolant which flows through the first jacket 22*a* highly-accurately and with a high response becomes important.

On the other hand, the second jacket 22*b* is formed so that it extends along a circumference part of the exhaust port 15 of each cylinder 11. The coolant which flows through the second jacket 22*b* mainly exchanges heat with (mainly, cools) the exhaust port 15 through which hot exhaust gas flows.

As illustrated in FIGS. 1 and 2, a water pump 3 is installed in the cylinder block 10B, at an end part (inflow-side end part 10*a*) of the engine body 10. The water pump 3 constitutes a part of the cooling system 2.

The water pump 3 is a mechanical pump in which a rotation shaft of a pump is coupled to a driving shaft of the engine 1 via a belt-pulley mechanism, etc. The water pump 3 operates by the driving force of the engine 1. Note that the water pump 3 may be an electric pump which can operate independently from the engine 1.

The in-block jacket 21 is connected with a discharge port 3*a* of the water pump 3 via a coolant introducing passage 23. Therefore, the coolant discharged from the water pump 3 flows into the in-block jacket 21 through the coolant introducing passage 23. The coolant which flowed into the in-block jacket 21 flows into the in-head jacket 22. In detail, it dividedly flows into the first jacket 22*a* and the second jacket 22*b*.

As illustrated in FIGS. 1 and 2, a coolant control valve 4 (CCV; an example of a "flow control device" in the disclosed technique) and a thermally-actuated valve 54 are installed in the cylinder head 10H, at an end part (outflow-side end part 10*b*) opposite from the inflow-side end part 10*a* of the engine body 10. The coolant control valve 4 and the thermally-actuated valve 54 constitute a part of the cooling system 2.

A pair of first coolant deriving passages 24 which communicate with the first jacket 22*a* are formed in the outflow-side end part 10*b* of the cylinder head 10H. One of the first coolant deriving passages 24 (a CCV-side first coolant deriving passage 24) is connected to the coolant control valve 4. The other first coolant deriving passage 24 (a thermostat-side first coolant deriving passage 24) is connected to a second radiator passage 52 via the thermally-actuated valve 54.

Therefore, the coolant which flows through the first jacket 22*a* flows out of the engine body 10 through the CCV-side first coolant deriving passage 24, and flows into the coolant control valve 4. Then, when the thermally-actuated valve 54 is open, the coolant flows out of the engine body 10 through the thermostat-side first coolant deriving passage 24, and flows into the second radiator passage 52. Details of the thermally-actuated valve 54 and the coolant control valve 4 will be described later.

A second coolant deriving passage 25 which communicates with the second jacket 22*b* is formed at a location of the outflow-side end part 10*b* on the exhaust side of the cylinder head 10H. Therefore, the coolant which flows through the second jacket 22*b* flows out of the engine body 10 through the second coolant deriving passage 25, and flows into a second circulation passage 31 (described later).

A third coolant deriving passage 26 which communicates with the in-block jacket 21 is formed at a location of the outflow-side end part 10*b* on the intake side of the cylinder block 10B. Therefore, part of the coolant which flows through the in-block jacket 21 flows out of the engine body 10 through the third coolant deriving passage 26, and flows into a third circulation passage 41 (described later).

Various auxiliary machines built into the cooling system 2 are mounted on the automobile in addition to the engine 1. In this automobile, an exhaust gas recirculation (EGR) cooler 5, an EGR valve 6, a heater 7, an oil cooler 8, and an automatic transmission fluid (ATF) heat exchanger 9 are mounted as such auxiliary machines.

Although not illustrated, an EGR system is additionally provided to the engine 1. The EGR cooler 5 and the EGR valve 6 are installed in the EGR system. The heater 7 is built into an air conditioner which adjusts air inside a vehicle cabin.

The oil cooler 8 is installed in a system which circulates lubricating oil and supplies it to the engine 1. The ATF heat exchanger 9 is installed in a system which circulates hydraulic fluid and supplies it to the automatic transmission. In this cooling system 2 of the engine 1, it also exchanges heat with these auxiliary machines, as well as the engine 1.

(Cooling System)

The structure and layout are devised for the cooling system 2 so that the advanced combustion control like Homogeneous Charge Compression Ignition combustion (so-called "HCCI combustion") can be performed by the engine 1.

In detail, as illustrated in FIG. 1, the cooling system 2 is provided with, in addition to the water pump 3, the coolant control valve 4, and the thermally-actuated valve 54 which are described above, a radiator 27 (an example of a "heat exchanger" in the disclosed technique). Roughly, the cooling system 2 is provided with, as passages through which the coolant circulates, a second circuit 30, a third circuit 40, and a first circuit 50.

(Second Circuit)

The second circuit 30 has the second circulation passage 31 where a passage which is branched into two (a first branch passage 31*a* and a second branch passage 31*b*) is provided. In the first branch passage 31*a*, the EGR cooler 5 and the heater 7 are disposed. The EGR valve 6 is disposed in the second branch passage 31*b*. An upstream end of the second circulation passage 31 is connected to the second coolant deriving passage 25. A downstream end of the second circulation passage 31 is connected to a suction port 3*b* of the water pump 3 in a state where it is joined to the first circuit 50 and the third circuit 40.

Inside the engine body 10, the in-block jacket 21, the second jacket 22*b*, and the second coolant deriving passage 25 constitute a passage of the second circuit 30. Therefore, in the second circuit 30, among the coolant discharged from the water pump 3, coolant which flowed through the in-block jacket 21 and the second jacket 22*b* is divided and flows into each of the first branch passage 31*a* and the second branch passage 31*b*. After being joined, it returns to the water pump 3.

The coolant which flows through the second circuit 30 exchanges heat with the engine 1 (mainly, with the exhaust port 15). Further, it also exchanges heat with the EGR cooler 5, the heater 7, and the EGR valve 6.

(Third Circuit)

The third circuit 40 has the third circulation passage 41 where the oil cooler 8 and the ATF heat exchanger 9 are installed. An upstream end of the third circulation passage 41 is connected to the third coolant deriving passage 26. A downstream end of the third circulation passage 41 is connected to the suction port 3*b* of the water pump 3 in a state where it is joined to the first circuit 50 and the second circuit 30.

Inside the engine body 10, the in-block jacket 21 and the third coolant deriving passage 26 constitute a passage of the third circuit 40. Therefore, in the third circuit 40, among the coolant discharged from the water pump 3, part of the coolant which flows through the in-block jacket 21 flows into the third circulation passage 41 and returns to the water pump 3. The coolant which flows through the third circuit 40 exchanges heat with the oil cooler 8 and the ATF heat exchanger 9.

(First Circuit)

The first circuit 50 has a bypass passage 53, a first radiator passage 51, and the second radiator passage 52. Inside the engine body 10, the in-block jacket 21, the first jacket 22*a*, and the pair of first coolant deriving passages 24 constitute a passage of the first circuit 50.

As described above, inside the engine body, the passage of the first circuit 50 branches into the two first coolant deriving passages 24, where one of them, the CCV-side first coolant deriving passage 24 is connected to the coolant control valve 4, and the other, the thermostat-side first coolant deriving passage 24 is connected to the second radiator passage 52 via the thermally-actuated valve 54.

The passage which goes through the CCV-side first coolant deriving passage 24 branches into the bypass passage 53 and the first radiator passage 51 in the coolant control valve 4. A downstream end of each of the bypass passage 53 and the first radiator passage 51 is connected to the suction port 3*b* of the water pump 3 in a state where it is joined to the second circuit 30 and the third circuit 40.

The radiator 27 is provided to the first radiator passage 51. The radiator 27 is installed rearward of a front grille of the automobile. The coolant which flows through the radiator 27 mainly exchanges heat with outside air caused by the vehicle traveling. The coolant radiates heat while flowing through the first radiator passage 51 so that it is cooled.

Therefore, the first radiator passage 51 cools, by the radiator 27, the coolant which is discharged from the water pump 3 and is heated by the heat exchange while the coolant flows through the in-block jacket 21 and the first jacket 22*a*, and recirculates it to the in-block jacket 21 and the first jacket 22*a*.

The bypass passage 53 is a passage which bypasses the first radiator passage 51. The bypass passage 53 is shorter than the first radiator passage 51, and is comprised only of piping.

Thus, the bypass passage 53 recirculates, to the in-block jacket 21 and the first jacket 22*a*, the coolant which is discharged from the water pump 3 and exchanges heat while flowing through the in-block jacket 21 and the first jacket 22*a* in a state almost as it is, without cooling by the radiator 27.

The passage which goes through the thermostat-side first coolant deriving passage 24 is connected to an upstream end of the second radiator passage 52. The thermally-actuated valve 54 is installed in the end of the second radiator passage 52. A downstream end of the second radiator passage 52 is connected to a part of the first radiator passage 51 upstream of the radiator 27. In other words, the second radiator passage 52 bypasses the coolant control valve 4, and is connected to the first radiator passage 51. Note that the thermally-actuated valve 54 may be installed at parts other than the end of the second radiator passage 52.

The thermally-actuated valve 54 is a known device which opens and closes at a high temperature set beforehand. The thermally-actuated valve 54 has a valve body which is biased in a closing direction by an elastic force of a spring. The valve body is displaced according to action of wax to open and close the thermally-actuated valve 54.

When the thermally-actuated valve 54 closes, the thermostat-side first coolant deriving passage 24 does not communicate with the second radiator passage 52 (the coolant does not flow). When the thermally-actuated valve 54 opens, the thermostat-side first coolant deriving passage 24 communicates with the first radiator passage 51 via the second radiator passage 52. Therefore, when the thermally-actuated valve 54 opens, the coolant which flows through the first jacket 22*a* passes through the second radiator passage 52, and flows into the first radiator passage 51.

Figure 4:
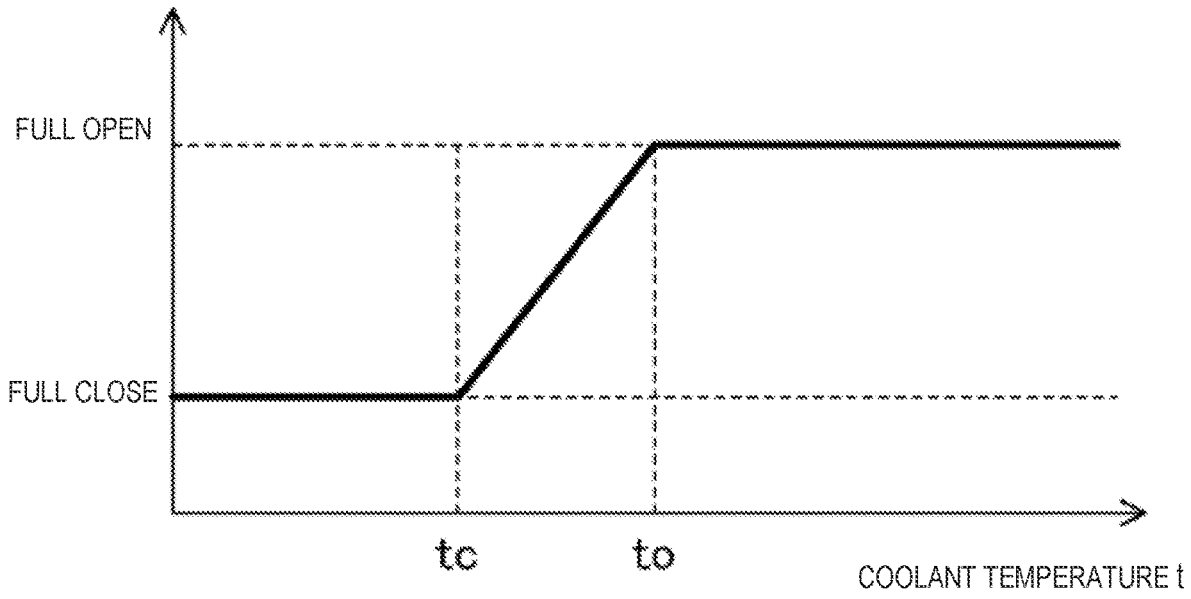
FIG. 4 is a graph illustrating an open-and-close operation of a thermally-actuated valve.

FIG. 4 illustrates open-and-close operation of the thermally-actuated valve 54. The thermally-actuated valve 54 fully opens when the temperature of the coolant which flows through the thermally-actuated valve 54 becomes above a given temperature (a fully-open temperature to, for example, 100° C.).

On the other hand, when the temperature of the coolant which flows through the thermally-actuated valve 54 becomes below the fully-open temperature to, the valve body is gradually displaced in a closing direction by the elastic force action of the spring caused by contraction of wax. The thermally-actuated valve 54 gradually closes. When the temperature of the coolant which flows through the thermally-actuated valve 54 becomes below the given temperature (a fully-closed temperature tc, for example, about 95° C.), the thermally-actuated valve 54 becomes fully closed. The thermally-actuated valve 54 automatically opens and closes according to the temperature of the coolant which flows through the thermally-actuated valve 54.

(Coolant Control Valve)

Figure 3:
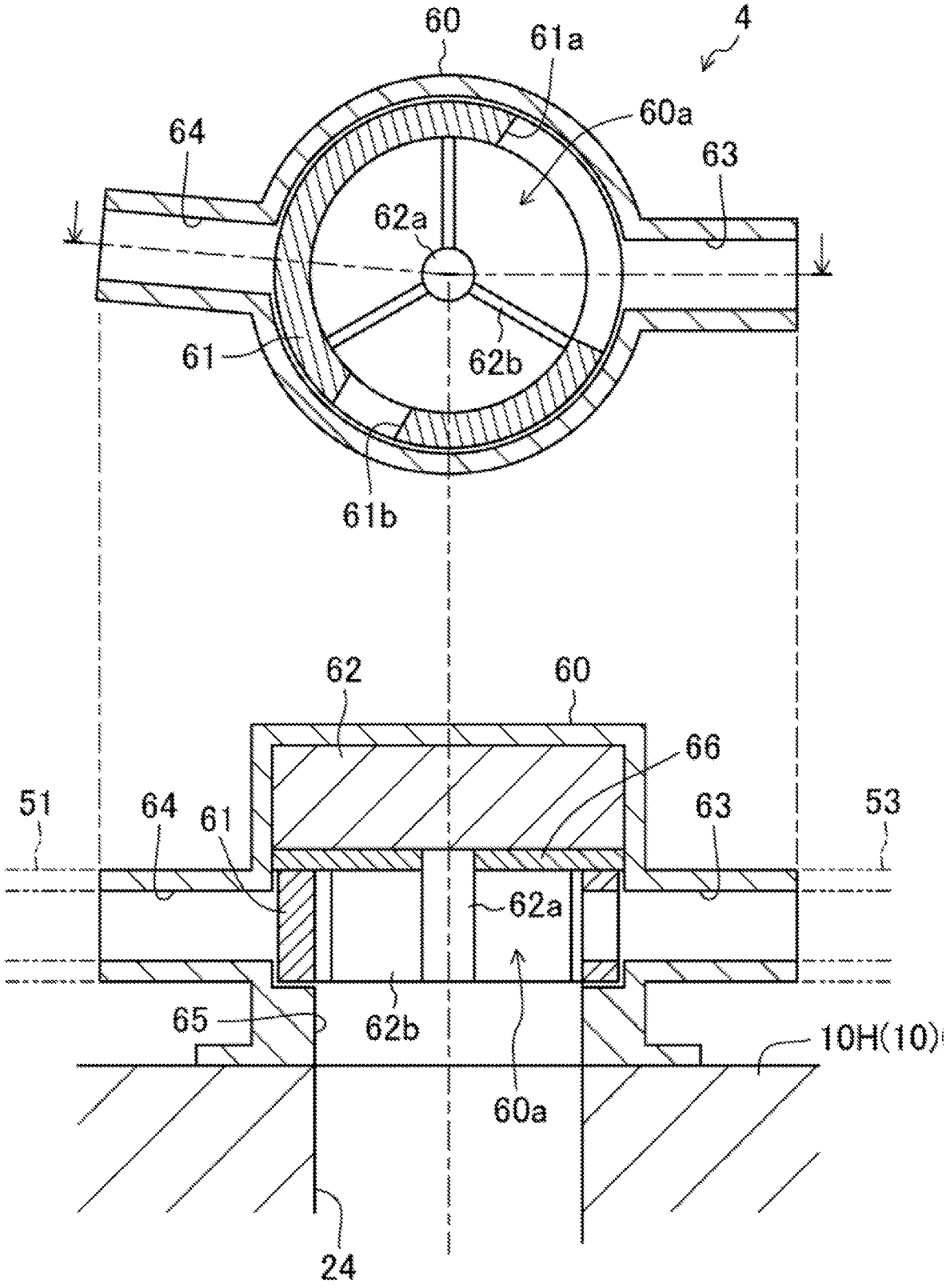
FIG. 3 is a schematic view illustrating a structure of a coolant control valve, where an upper figure is a longitudinal cross section of the coolant control valve, and a lower figure is a transverse cross section when seen in a direction indicated by an arrow of the upper figure.

FIG. 3 illustrates the coolant control valve 4. The coolant control valve 4 is a valve which can adjust a flow rate of the coolant, and is comprised of a housing 60, a rotary valve body 61, and an actuator 62.

A cylindrical branching chamber 60*a* is provided inside the housing 60. The cylindrical rotary valve body 61 is rotatably accommodated in the branching chamber 60*a*. In the housing 60, a first passage 63 and a second passage 64 are formed so that they extend radially outward from a given position in the outer circumference of the branching chamber 60*a*. The housing 60 is also provided with the bypass passage 53 and the first radiator passage 51. The first passage 63 is connected to the bypass passage 53. The second passage 64 is connected to the first radiator passage 51.

The branching chamber 60*a* opens at one end thereof. This opening constitutes an inflow opening 65 through which the coolant flows into the branching chamber 60*a*. The housing 60 is attached to the cylinder head 10H so that the inflow opening 65 is coaxially connected to the CCV-side first coolant deriving passage 24. Therefore, a circumferential wall of the rotary valve body 61 intervenes between the inflow opening 65 and each of the first passage 63 and the bypass passage 53, and the second passage 64, and the first radiator passage 51.

A first water flow opening 61*a* and a second water flow opening 61*b* are formed at a given position of the circumferential wall of the rotary valve body 61. The first water flow opening 61*a* is longer in length in the circumferential direction than the second water flow opening 61*b*, and has a relatively large opening area. Depending on the rotational position of the rotary valve body 61, the inflow opening 65 communicates or does not communicate with each of the first passage 63 and the second passage 64 via each of the first water flow opening 61*a* and the second water flow opening 61*b*. Further, while communicating, an opening between each of the first passage 63 and the second passage 64 and the inflow opening 65 varies according to the rotational position of the rotary valve body 61.

The other end of the branching chamber 60*a* is sealed with a closure wall 66. The actuator 62 is accommodated inside the housing 60, at the opposite side of the branching chamber 60*a* with respect to the closure wall 66. A rotation shaft 62*a* of the actuator 62 projects into the branching chamber 60*a* through a shaft hole which opens at the center of the closure wall 66. The rotary valve body 61 is attached via support arms 62*b* to the rotation shaft 62*a* projected into the branching chamber 60*a*. The rotary valve body 61 rotates by controlling the actuator 62.

As illustrated in FIG. 1, in the cooling system 2, an inlet water temperature sensor S1 and an in-jacket water temperature sensor S2 are installed. The inlet water temperature sensor S1 is disposed in a passage where the first circuit 50, the second circuit 30, and the third circuit 40 join and flow into the water pump 3. The in-jacket water temperature sensor S2 is disposed at the first jacket 22*a*. The inlet water temperature sensor S1 measures a temperature of the entire coolant which circulates the cooling system 2. The in-jacket water temperature sensor S2 measures a temperature of the coolant which flows through the first jacket 22*a*.

These sensors S1 and S2 are used for a coolant control and a combustion control. For example, when performing the advanced combustion control, the in-jacket water temperature sensor S2 is used for estimating the wall temperature of the combustion chamber 13. The in-jacket water temperature sensor S2 is also used for controlling the actuator 62.

This cooling system 2 controls the coolant control valve 4 based on the measurement of the in-jacket water temperature sensor S2. This adjusts an amount of coolant which flows into the first circuit 50 (i.e., the bypass passage 53 and the first radiator passage 51). Note that a flow of the coolant in the second radiator passage 52 is automatically adjusted by the thermally-actuated valve 54.

The coolant which flows through the cooling system 2 is mainly cooled by the radiator 27 installed in the first radiator passage 51. Therefore, the temperature of the coolant which flows into the cooling system 2 is adjusted.

That is, the main constituent of the cooling system 2 is the first circuit 50. The flow rate and the temperature of the coolant in each of the second circuit 30 and the third circuit 40 change according to the adjustment of the flow rate and the temperature of the coolant in the first circuit 50. In this cooling system 2, although the first circuit 50 is essential, the second circuit 30 and the third circuit 40 are not essential.

<How Coolant Flows>

As described above, the coolant which flows through the first jacket 22*a* mainly exchanges heat with the combustion chamber 13 to cool the wall temperature of the combustion chamber 13. In this cooling system 2, in order to perform the combustion control of the engine 1 stably and efficiently, a plurality of ways of the coolant to flow are set according to the temperature of the coolant which flows through the first jacket 22*a* (the measurement of the in-jacket water temperature sensor S2).

Figure 5:
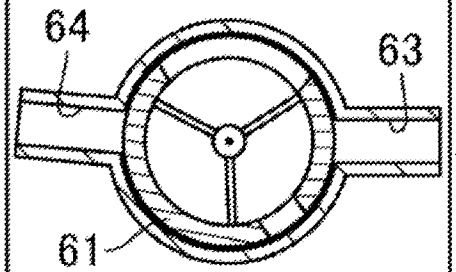
FIG. 5 illustrates a table where how the coolant flows is summarized.
Figure 5:
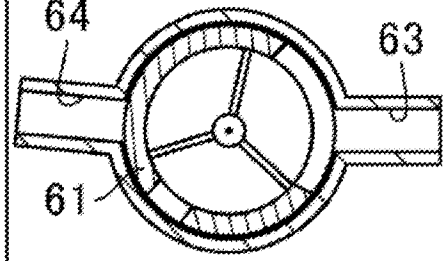
Figure 5:
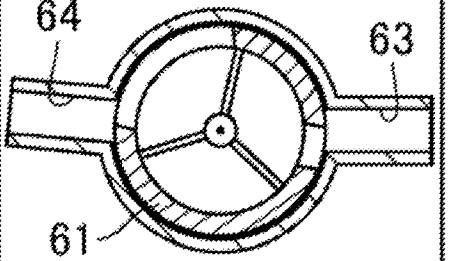
Figure 6:
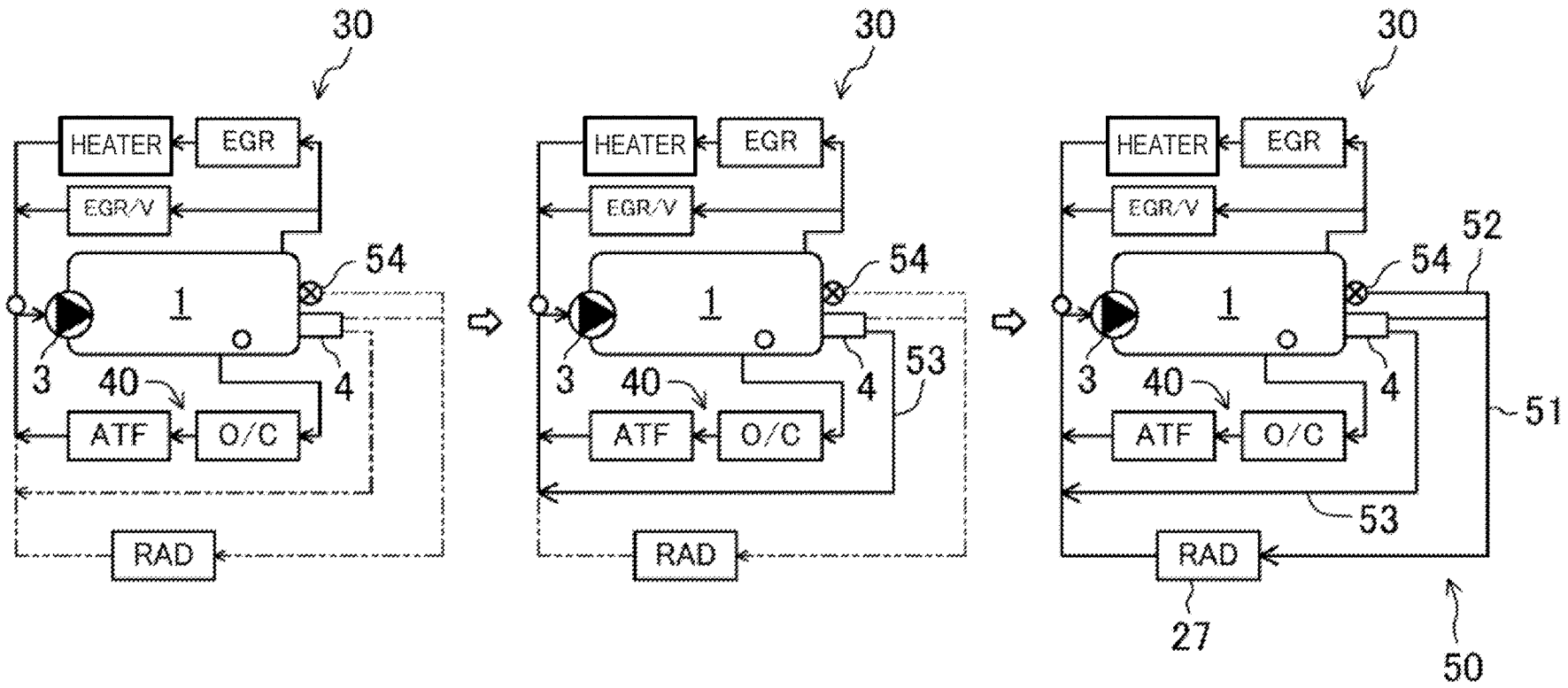
FIG. 6 is a view illustrating a flowing state in the cooling system corresponding to the table of FIG. 5.

FIG. 5 illustrates a table where the water flow patterns are summarized. An upper row of the table illustrates the temperature state of the combustion chamber 13. A middle row of the table illustrates the flowing state of the first circuit 50 according to the temperature state. A lower row of the table illustrates the state of the coolant control valve 4 according to the temperature state. Further, FIG. 6 illustrates the flowing state of each circuit in the cooling system 2 corresponding to the table of FIG. 5.

In the coolant control valve 4, the actuator 62 is controlled so that the amounts of coolant which flows into both the first passage 63 and the second passage 64 are adjusted. That is, the opening of each of the first water flow opening 61*a* and the second water flow opening 61*b* is changed so that the rotary valve body 61 becomes at a given rotational position.

"Low Temperature" is in a state of a so-called "cold start," such as immediately after a startup of the engine 1. "Low Temperature" is a state where the temperature of the coolant which flows through the first jacket 22*a* (first change temperature) is below 40° C., for example. "Full Warm-up" in a state where the engine 1 becomes warm at a temperature suitable for the operation of the engine 1, and is a so-called warm state.

"Full Warm-up" is a state where the temperature of the coolant which flows through the first jacket 22*a* (second change temperature) is above 80° C., for example. "Warm-up" is a state between "Low Temperature" and "Full Warm-up" (i.e., a transition stage). "Warm-up" is a state where the temperature of the coolant which flows through the first jacket 22*a* is 40° C. to 80° C., for example (above the first change temperature and below the second change temperature).

FIG. 6 illustrates in a left figure a state of the cooling system during "Low Temperature." The temperature of the coolant is lower than the fully-closed temperature tc. Therefore, the thermally-actuated valve 54 is fully closed. The coolant will not pass through the second radiator passage 52 and flow into the first radiator passage 51.

At the coolant control valve 4, the coolant neither flows into the first radiator passage 51 nor the bypass passage 53 (a flow rate of both the passages is zero). That is, the circulation of the coolant is not performed in the first circuit 50. At this time, the coolant control valve 4 is set so that the rotary valve body 61 is at a rotational position where both the first passage 63 and the second passage 64 do not communicate with the inflow opening 65.

Since the coolant does not flow into the first radiator passage 51, the coolant will not be cooled by the radiator 27. Therefore, the coolant promptly increases in the temperature. In addition, the combustion chamber 13 will not be cooled by the circulation of the coolant. The combustion chamber 13 can be promptly heated by combustion heat. Since the engine 1 promptly starts to the temperature state suitable for combustion, fuel efficiency can be improved. At this time, the coolant discharged from the water pump 3 circulates through the second circuit 30 and the third circuit 40.

FIG. 6 illustrates in a center figure a state of the cooling system during "Warm-up." Also during "Warm-up," the temperature of the coolant is lower than the fully-closed temperature tc. Therefore, the thermally-actuated valve 54 is fully closed. The coolant will not pass through the second radiator passage 52, and flow into the first radiator passage 51.

On the contrary, although the coolant control valve 4 does not allow the coolant to flow into the first radiator passage 51 during "Warm-up" (the flow rate of the first radiator passage 51 is zero), it allows the coolant to flow into the bypass passage 53. That is, in the first circuit 50, the coolant circulates only through the bypass passage 53. At this time, the coolant control valve 4 is set so that the rotary valve body 61 is at a rotational position where only the first passage 63 communicates with the inflow opening 65. An opening between the first passage 63 and the inflow opening 65 is fully open.

Since the coolant does not flow into the first radiator passage 51, the coolant promptly increases in the temperature. On the other hand, since the coolant flows into the bypass passage 53, the coolant flows into the first jacket 22*a*. The bypass passage 53 is short. Further, since the coolant control valve 4 is set to be fully opened, most of the coolant flows through the bypass passage 53 and the first jacket 22*a*.

The combustion chamber 13 can be promptly heated by the circulating coolant. Since the coolant circulates, the combustion chamber 13 and its circumference can be heated uniformly. Since the engine 1 promptly starts to the temperature state suitable for combustion, fuel efficiency can be improved. Note that, at this time, the remainder of the coolant discharged from the water pump 3 circulates through the second circuit 30 and the third circuit 40 (also similar during "Full Warm-up").

FIG. 6 illustrates in a right figure a state of the cooling system during "Full Warm-up." During "Full Warm-up," the engine 1 reaches the temperature state suitable for combustion.

Therefore, as the load of the engine 1 changes, the temperature of the coolant which flows through the first jacket 22*a* can become above 100° C. and can become below 95° C. Therefore, in "Full Warm-up," the thermally-actuated valve 54 opens and closes.

When the load of the engine 1 increases and the combustion chamber 13 becomes high in the temperature, the combustion chamber 13 needs to be cooled in order to keep the engine 1 at the temperature state suitable for combustion. Thus, during "Full Warm-up," the circulation of the coolant is performed using the entire first circuit 50.

For example, the coolant flows into both the bypass passage 53 and the first radiator passage 51. In that case, the coolant control valve 4 is set so that the rotary valve body 61 is at a rotational position where both the first passage 63 and the second passage 64 communicate with the inflow opening 65. During "Full Warm-up," the flow rate of the coolant is adjusted in both the first passage 63 (bypass passage 53) and the second passage 64 (first radiator passage 51) according to the load of the engine 1.

That is, in order to enable the advanced combustion control like HCCI combustion, the water flow control and the water temperature control of the coolant which flows into the first jacket 22*a* are performed according to the load of the engine 1. Therefore, the wall temperature of the combustion chamber 13 can be accurately held at the given high temperature.

(How Coolant Flows During Full Warm-Up)

Figure 7:
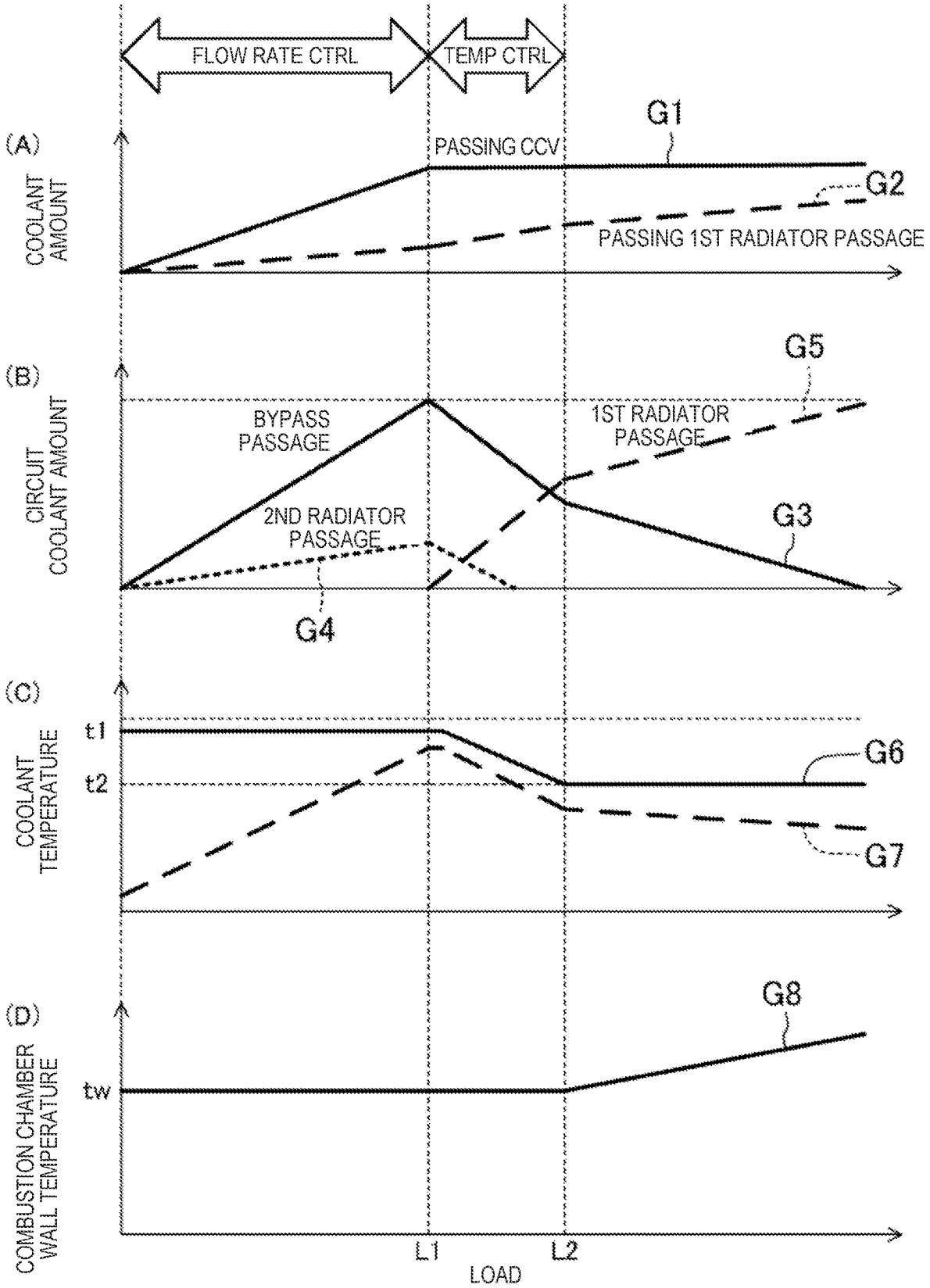
FIG. 7 is a view illustrating how the coolant flows during full warm-up.

FIG. 7 illustrates one concrete example of how the coolant flows during Full Warm-up. FIG. 7 illustrates changes in main parameters according to the load of the engine 1 respectively in charts (A) to (D).

Chart (A) illustrates a change G1 in the total amount of the coolant which passes through the coolant control valve 4, and a change G2 in the amount of coolant which passes through the first radiator passage 51. Chart (B) illustrates details of the change in the amount of coolant which flows through the first circuit 50 (that is, a change G3 in the amount of coolant which flows into the bypass passage 53 from the coolant control valve 4, a change G4 in the amount of coolant which flows through the second radiator passage 52, and a change G5 in the amount of coolant which flows into the first radiator passage 51 from the coolant control valve 4.)

Chart (C) illustrates a change G6 in the temperature of the coolant which flows through the first jacket 22*a*, and a change G7 in the temperature of the coolant which flows into the water pump 3. In other words, changes in the measurements of the in jacket water temperature sensor S2 and the inlet water temperature sensor S1 are illustrated. Chart (D) illustrates a change G8 in the wall temperature of the combustion chamber 13.

The load range of the engine 1 is divided into three ranges, in association with the control of the coolant, which is comprised of a range below a first load L1 (low-load range), a range above a second load L2 (high-load range), and a range above the first load L1 and below the second load L2 (middle-load range). The first load L1 and the second load L2 are values which are defined according to conditions, such as specifications of the engine 1 and the cooling system 2, and the ambient temperature.

In this cooling system 2, the water flow control is performed in the low-load range, and the water temperature control is performed in the middle-load range. Therefore, in the low-load range and the middle-load range of the engine 1, the advanced combustion control like HCCI combustion can be performed.

That is, in order to realize such an advanced combustion control, it is necessary to accurately control the temperature inside the combustion chamber 13 (in-cylinder temperature) at the temperature higher than the common spark ignition combustion (SI combustion). On the other hand, since combustion heat decreases when the load of the engine 1 becomes smaller, the wall temperature of the combustion chamber 13 is required to be increased in order to maintain the suitable in-cylinder temperature. On the other hand, since the combustion heat increases when the load of the engine 1 becomes larger, the wall temperature of the combustion chamber 13 is required to be decreased.

In order to accurately realize both the demands, it is required that a heat exchanging quantity (cooling quantity) by the coolant which flows through the first jacket 22*a* is stably controlled with high response. On the other hand, conventionally, the cooling quantity by the coolant which flows through the first jacket 22*a* is controlled by cooling the coolant by the radiator 27 and controlling the temperature of the coolant.

However, since the calorific capacity of coolant is large, it needs a long period of time for raising and lowering the temperature of the coolant. Therefore, the required response cannot be acquired by this method of controlling the temperature of the coolant. In addition, the influence of the external causes, such as the environmental temperature, is also great. Therefore, the realization of the stable control is difficult only by this method. On the other hand, the flow rate of the coolant can be fluctuated in a short period of time. The heat transfer coefficient can be adjusted with high response. Thus, in this cooling system 2, by performing not only the water temperature control of the coolant but also performing the water flow control of the coolant, the cooling by the coolant which flows through the first jacket 22*a* can be stably controlled with high response.

In detail, the amount of coolant which flows through the first passage 63 is controlled using the coolant control valve 4. Therefore, the amount of coolant which flows through the first jacket 22*a* is changed to adjust the heat transfer coefficient between the first jacket 22*a* and the combustion chamber 13.

(Low-Load Range)

As illustrated in FIG. 7, in the low-load range, the coolant control valve 4 adjusts the amount of coolant which flows through the bypass passage 53, without the coolant flowing through the first radiator passage 51 (see G3, G5). In detail, in the low-load range, the coolant control valve 4 adjusts the amount of coolant so that it reduces the amount of coolant which flows through the bypass passage 53 as the load of the engine 1 decreases.

At this time, the coolant control valve 4 controls the actuator 62 so that the rotary valve body 61 is located at a rotational position where the inflow opening 65 does not communicate with the second passage 64, and the inflow opening 65 communicates with the first passage 63. Then, the opening between the inflow opening 65 and the first passage 63 is adjusted according to the load of the engine 1.

The coolant which flows out of the coolant control valve 4 flows into the bypass passage 53 and circulates between the first radiator passage 51 and the first jacket 22*a*, without flowing into the first radiator passage 51. Unless the coolant flows into the first radiator passage 51, the coolant will not be cooled by the radiator 27. The coolant flows into the first radiator passage 51 only when the thermally-actuated valve 54 opens, and the coolant flows into the second radiator passage 52.

That is, the temperature of the coolant in the low-load range is determined by the thermally-actuated valve 54. On the other hand, the temperature at which the thermally-actuated valve 54 opens and closes is set at a comparatively high temperature. Therefore, the temperature of the coolant which flows through the first jacket 22*a* becomes high. By setting the temperature of the coolant high, it becomes possible to maintain the wall temperature of the combustion chamber 13 at the comparatively high temperature (that is, a target temperature tw). Note that, in the low-load range, since the coolant hardly flows into the first radiator passage 51, the temperature of the entire coolant rises gradually as the load of the engine 1 increases (see G7).

If the amount of coolant which flows through the bypass passage 53 (i.e., the first jacket 22*a*) decreases, the heat transfer coefficient between the first jacket 22*a* and the combustion chamber 13 also decreases accordingly. Therefore, even if the load decreases and the combustion heat decreases, the wall temperature of the combustion chamber 13 can be adjusted higher because the amount of coolant decreases accordingly. If the amount of coolant which flows through the first jacket 22*a* increases, the heat transfer coefficient between the first jacket 22*a* and the combustion chamber 13 also increases accordingly. Therefore, even if the load increases and the combustion heat increases, the wall temperature of the combustion chamber 13 can be adjusted low because the amount of coolant increases accordingly.

As the result, the wall temperature of the combustion chamber 13 can be held constant (see G8).

Further, in this engine 1, in order to enable the advanced combustion control, the target wall temperature tw of the combustion chamber 13 is set higher than conventional techniques. Accordingly, a first target water temperature t1 of the coolant which flows into the first jacket 22*a* is also set higher (for example, 100° C.). Note that a broken line above the target wall temperature tw indicates a confidence limit of the coolant temperature.

In the low-load range, part of the coolant which flows through the first jacket 22*a* flows into the first radiator passage 51 through the second radiator passage 52 (see G4). In detail, the coolant at the first target water temperature t1 flows in the first jacket 22*a* through the CCV-side first coolant deriving passage 24. Therefore, although depending on the situations, such as the ambient temperature and the wind velocity, the temperature inside the end part of the second radiator passage 52 provided with the thermally-actuated valve 54 normally becomes below the fully-open temperature to and above the fully-close temperature tc.

As a result, the thermally-actuated valve 54 is in a state where it is partially opened, and therefore, part of the coolant which flows through the first jacket 22*a* flows into the second radiator passage 52. Note that since the amount of coolant is small, its influence on the temperature of the entire coolant is small.

On the other hand, when the temperature of the coolant which flows through the first jacket 22*a* becomes excessively high, the thermally-actuated valve 54 becomes fully opened. That is, when the temperature of the coolant which flows through the thermally-actuated valve 54 becomes above the fully-open temperature to, the thermally-actuated valve 54 becomes fully opened. Most of the coolant which flows through the first jacket 22*a* flows into the first radiator passage 51 through the second radiator passage 52.

Therefore, the coolant is cooled. The temperature of the entire coolant is reduced. Therefore, it can suppress that the temperature of the coolant which circulates through the cooling system 2 becomes excessively high. Further, if the fully-open temperature to and the first target water temperature t1 are set at substantially the same temperature, the temperature of the coolant which flows into the first jacket 22*a* can be controlled more stably to the first target water temperature t1.

(Middle-Load Range)

In the first load L1, the amount of coolant which flows into the coolant control valve 4 (i.e., the amount of coolant which flows into the first circuit 50) reaches the upper limit (see G1). That is, above the first load L1, the water flow control cannot be performed. Thus, in the middle-load range, the cooling of the coolant is started. By gradually allowing the coolant which flows through the bypass passage 53 to flow into the first radiator passage 51 and cooling the coolant, the target wall temperature tw is held.

In detail, while holding the amount of coolant which flows into the first circuit 50 at the maximum, the coolant control valve 4 gradually reduces the amount of coolant which flows into the first passage 63, and gradually increases the amount of coolant which flows into the second passage 64 (see G1, G2, G3, and G5). In the middle-load range, the coolant control valve 4 adjusts the temperature of the coolant which flows into the first jacket 22*a* by adjusting the amount of coolant which flows through the second passage 64.

At this time, the coolant control valve 4 controls the actuator 62 so that the rotary valve body 61 is located at the rotational position where the inflow opening 65 communicates with both the first passage 63 and the second passage 64. Then, the opening between the inflow opening 65 and each of the first passage 63 and the second passage 64 is adjusted according to the load of the engine 1.

Therefore, the temperature of the entire coolant which includes the coolant which flows into the first jacket 22*a* decreases gradually (see G6, G7). Since the temperature of the coolant which flows through the first jacket 22*a* decreases even when the amount of coolant is constant, the cooling quantity by the coolant which flows through the first jacket 22*a* can be maintained. As a result, also in the middle-load range, the wall temperature of the combustion chamber 13 can be held at the target wall temperature tw (see G8).

In this cooling system 2, in order to suppress the excessive temperature increase of the combustion chamber 13, a second target water temperature t2 (for example, 88° C.) lower than the first target water temperature t1 is set as a target temperature of the coolant which flows into the first jacket 22*a*. The water temperature control is performed until the temperature of the coolant which flows into the first jacket 22*a* reaches the second target water temperature t2.

Thus, in this cooling system 2, when the water flow control can be performed, the water temperature control is not performed. On the other hand, when the water flow control cannot be performed, the water temperature control is performed. In addition, the former (i.e., the temperature of the coolant which flows through the first jacket 22*a* in the low-load range) is set higher than the latter (i.e., the temperature of the coolant which flows through the first jacket 22*a* in the middle-load range) (see G6).

In the water temperature control, the coolant cooled by the radiator adjusts the heat exchanging quantity. On the other hand, in the water flow control, the heat exchanging quantity is adjusted by fluctuating the amount of coolant which circulates while bypassing the radiator. Therefore, the water flow control excels the water temperature control in the response and stability. The water flow control can stably control the water temperature even if it is set to a high temperature.

Further, in the water temperature control, the water temperature is lowered while maintaining the amount of coolant which flows through the first jacket 22*a* at the maximum. Although the water temperature control is inferior to the water flow control in the response, since the heat exchange progresses comparatively quietly in the water temperature control, it can hold the combustion chamber wall temperature constant.

Thus, in this cooling system 2, it becomes possible to hold the wall temperature of the combustion chamber 13 constant at the high temperature within a wide load range of the engine 1, and the advanced combustion control, such as HCCI combustion, can be performed. Therefore, the engine 1 excellent in fuel efficiency can be realized.

In the middle-load range, the coolant which flows into the first radiator passage 51 through the second radiator passage 52 gradually decreases as the load of the engine 1 increases, and will no longer flow (see G4). In detail, the temperature of the coolant which flows into the second radiator passage 52 from the first jacket 22*a* decreases gradually from the first target water temperature t1. In connection with it, the temperature of the coolant which flows through the thermally-actuated valve 54 also decreases. The second target water temperature t2 is lower than the fully-closed temperature tc.

Therefore, in the middle-load range, the thermally-actuated valve 54 is gradually closed, and becomes fully closed. Therefore, the coolant which flows into the first radiator passage 51 through the second radiator passage 52 gradually decreases, and will no longer flow.

(High-Load Range)

In the high-load range, the conventional control based on the cooling of the coolant by the radiator 27 is performed. That is, in order to suppress the excessive temperature increase of the combustion chamber 13, the water temperature control for holding the temperature of the entire coolant, which flows into the water jacket 20 including the first jacket 22*a*, low is performed.

In detail, when the temperature of the coolant which flows into the first jacket 22*a* is cooled to the second target water temperature t2 by the water temperature control in the middle-load range, it becomes in the high-load range. Then, in the high-load range, the coolant control valve 4 performs the water amount adjustment so that the temperature of the coolant which flows into the first jacket 22*a* is held at the second target water temperature t2. In order to lower the temperature of the entire coolant, the coolant control valve 4 adjusts the amount of coolant so that more coolant flows into the first radiator passage 51.

In detail, the actuator 62 is controlled, and the adjustment is made so that, as the load of the engine 1 increases, the opening between the inflow opening 65 and the second passage 64 becomes larger and the opening between the inflow opening 65 and the first passage 63 becomes smaller. Therefore, the coolant which flows into the first radiator passage 51 gradually increases, and the coolant which flows into the bypass passage 53 gradually decreases (see G3, G5).

Thus, the temperature of the coolant which flows into the first jacket 22*a* can be held at the second target water temperature t2, and the temperature of the entire coolant can also be held low (see G6, G7). Since the water temperature control and the control for holding at the second target water temperature t2 are switched therebetween at a timing when the temperature of the coolant which flows into the first jacket 22*a* becomes the second target water temperature t2, the control can be switched smoothly for different contents of the coolant, and therefore, the continuity of the coolant control can be secured.

On the other hand, at this timing, since the target of the control is changed from the wall temperature of the combustion chamber 13 to the temperature of the coolant which flows into the first jacket 22*a*, degrees of change in the amount of coolant which flows into the bypass passage 53 from the coolant control valve 4, and the amount of coolant which flows into the first radiator passage 51 from the coolant control valve 4 changes at this timing (see G3, G5).

In the high-load range, the wall temperature of the combustion chamber 13 also gradually increases as the load of the engine 1 gradually increases (see G8). However, since the temperature of the coolant which flows through the first jacket 22*a* is held at the second target water temperature t2, the excessive temperature increase can be suppressed.

Note that, in the high-load range, the thermally-actuated valve 54 is fully closed. The coolant does not flow into the second radiator passage 52. Note that, in the coolant control valve 4, the flow control may not be performed properly because the rotary valve body 61 is stuck. In such an abnormal state, the temperature of the coolant which flows through the first jacket 22*a* rises, and the combustion chamber 13 can become excessively high in the temperature (so-called "overheated").

On the other hand, in this cooling system 2, the second radiator passage 52 which bypasses the coolant control valve 4 and allows the coolant to flow into the first radiator passage 51 is provided. When the temperature of the coolant of the first jacket 22*a* exceeds the fully-closed temperature tc, the thermally-actuated valve 54 opens automatically, and the coolant of the first jacket 22*a* flows into the first radiator passage 51 through the second radiator passage 52. Therefore, according to this cooling system 2, it can suppress that the engine 1 is overheated, even if the abnormality occurs in the coolant control valve 4.

Thus, according to this cooling system 2, the heat exchange (cooling) with the combustion chamber 13 by the coolant can be stably controlled with high response. As a result, the engine 1 can stably perform the advanced combustion control, such as HCCI combustion, and therefore, fuel efficiency can be improved. Even if the abnormality occurs in the coolant control valve 4, it can suppress the overheat of the engine 1.

<Modification of Cooling System>

Figure 8:
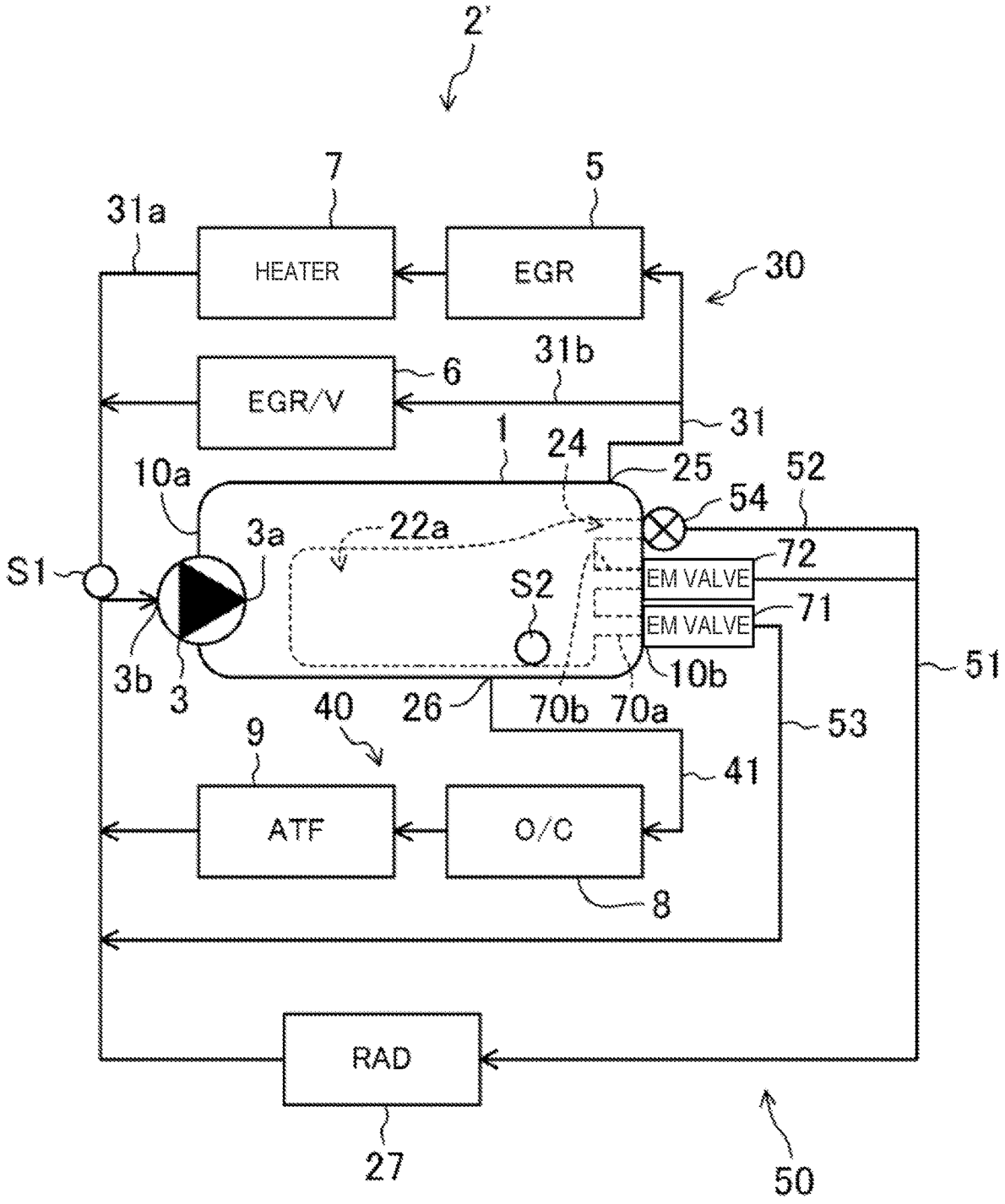
FIG. 8 is a schematic view illustrating a modification of the cooling system for the engine.

FIG. 8 illustrates another cooling system 2' (a modification of the cooling system 2) of the engine. This cooling system 2' differs from the cooling system 2 described above in the flow control device.

That is, in the cooling system 2 described above, the coolant control valve 4 is illustrated as the flow control device. On the other hand, in this cooling system 2', the flow control device is comprised of two electromagnetic valves 71 and 72. Note that since other configurations are the same as the above embodiment, the same reference characters are used for the same configurations to omit their explanations.

In this cooling system 2', as simply illustrated in FIG. 8, instead of the CCV-side first coolant deriving passage 24, two outflow paths (a first outflow path 70*a* and a second outflow path 70*b*) which are branched from the first jacket 22*a* are formed inside the cylinder head 10H, at the outflow-side end part 10*b* of the engine body 10. The first outflow path 70*a* is connected to the bypass passage 53, and the second outflow path 70*b* is connected to the first radiator passage 51.

Further, the first electromagnetic valve 71 is installed at a connection part (it constitutes the first passage 63) between the first outflow path 70*a* and the bypass passage 53. The second electromagnetic valve 72 is installed at a connection part (it constitutes the second passage 64) between the second outflow path 70*b* and the first radiator passage 51. The first electromagnetic valve 71 opens and closes the first passage 63. The second electromagnetic valve 72 opens and closes the second passage 64.

This cooling system 2' adjusts the amount of coolant which flows through the first passage 63 and the second passage 64 by controlling the first electromagnetic valve 71 and the second electromagnetic valve 72, respectively. For example, like during "Low Temperature," when the coolant does not flow into both the bypass passage 53 and the first radiator passage 51, both the first electromagnetic valve 71 and the second electromagnetic valve 72 may be closed.

Further, like during "Full Warm-up," when the coolant flows into both the bypass passage 53 and the first radiator passage 51 and the amount of coolant is adjusted, the opening and closing timings of the first electromagnetic valve 71 and the second electromagnetic valve 72 may be adjusted according to the amount of coolant. For example, if a duty control is performed to repeatedly open and close the valves, the amount of coolant which flow into both the bypass passage 53 and the first radiator passage 51 can be adjusted accurately.

According to the cooling system 2' of the modification, since the flow control device is comprised of the two electromagnetic valves 71 and 72, the system configuration can be compact.

Note that the disclosed technique is not limited to the above embodiment, but also encompasses other various configurations.

For example, in the cooling systems 2 and 2' of the embodiment and the modification, the flow control device is disposed at the exit of the first jacket 22*a*. However, since the coolant circulates through the first circuit 50, the flow control device may also be disposed at parts other than the exit of the first jacket 22*a*. For example, the flow control device may be disposed near the suction port 3*b* of the water pump 3 so that the coolant flows into the flow control device from both the bypass passage 53 and the first radiator passage 51.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims.

DESCRIPTION OF REFERENCE CHARACTERS

1 Engine
2 Cooling System
3 Water Pump
4 Coolant Control Valve (Flow Control Device)
10 Engine Body
10B Cylinder Block
10H Cylinder Head
13 Combustion Chamber
22*a* First Jacket (Water Jacket)
22*b* Second Jacket
27 Radiator (Heat Exchanger)
30 Second Circuit
31 Second Circulation Passage
40 Third Circuit
41 Third Circulation Passage
50 First Circuit
51 First Radiator Passage
52 Second Radiator Passage
53 Bypass Passage
54 Thermally-actuated Valve
60 Housing
61 Rotary Valve Body
62 Actuator
63 First Passage
64 Second Passage
65 Inflow Opening
S1 Inlet Water Temperature Sensor
S2 In-jacket Water Temperature Sensor

What is claimed is:

1. A cooling system for an engine, comprising:

a water jacket formed in a cylinder head of the engine and through which coolant flows;

a heat exchanger that cools the coolant;

a bypass passage that bypasses the heat exchanger and recirculates the coolant to the water jacket;

a first radiator passage that recirculates the coolant to the water jacket via the heat exchanger;

a coolant control valve installed at a location where a passage of the coolant branches into the bypass passage and the first radiator passage;

a second radiator passage that bypasses the coolant control valve and is connected to the first radiator passage; and a thermally-actuated valve installed in the second radiator passage, wherein the coolant control valve performs a water flow control to adjust an amount of the coolant flowing into the water jacket by adjusting an amount of the coolant flowing through the bypass passage, wherein the coolant flows into the first radiator passage through the second radiator passage, when the thermally-actuated valve opens, wherein the coolant control valve performs a water temperature control to adjust a temperature of the coolant which flows into the water jacket by adjusting an amount of the coolant flowing through the first radiator passage, wherein, during a first operating range, the coolant control valve adjusts the amount of the coolant flowing into the water jacket by flowing the coolant into the bypass passage without the coolant flowing through the first radiator passage and increasing the amount of coolant flowing into the bypass passage until a maximum flow rate as an engine load increases, and wherein, during a second operating range, the coolant control valve adjusts the temperature of the coolant flowing into the water jacket by maintaining the amount of the coolant at the maximum flow rate and increasing the amount of the coolant flowing into the first radiator passage while decreasing the amount of the coolant flowing into the bypass passage, as the engine load increases.

2. The cooling system of claim 1, wherein the coolant control valve includes:

a housing provided with the bypass passage, the first radiator passage, and an inflow opening through which the coolant inflows;

a rotary valve body rotatably accommodated in the housing, intervening between the inflow opening and each of the bypass passage and the first radiator passage, and allowing the coolant that inflows through the inflow opening to pass through a first water flow opening to flow into the bypass passage and through a second water flow opening to flow into the first radiator passage; and an actuator that rotates the rotary valve body, wherein the amounts of the coolant flowing through the bypass passage and the first radiator passage are adjusted by controlling the actuator and changing openings of the first water flow opening and the second water flow opening, respectively.

3. The cooling system of claim 2, wherein the temperature of the coolant flowing through the water jacket during the first operating range when the water flow control is performed and the water temperature control is not performed is set higher than the temperature of the coolant flowing through the water jacket during the second operating range when the water temperature control is performed and the water flow control is not performed.

4. The cooling system of claim 1, wherein the temperature of the coolant flowing through the water jacket during the first operating range when the water flow control is performed and the water temperature control is not performed is set higher than the temperature of the coolant flowing through the water jacket during the second operating range when the water temperature control is performed and the water flow control is not performed.

* * * * *